US005636773A

United States Patent [19]

Harrod et al.

[11] Patent Number: 5,636,773

[45] Date of Patent: Jun. 10, 1997

[54] METHOD AND APPARATUS FOR FINISHING THE SLEEVES AND PRESSING THE BODY OF A SHIRT IN COMBINATION WITH AN INTEGRATED COLLAR/CUFF PRESSER

[75] Inventors: Michael K. Harrod, Valrico; Charles E. Devrick, Tampa, both of Fla.

[73] Assignee: Unipress Corporation, Tampa, Fla.

[21] Appl. No.: 388,683

[22] Filed: Feb. 15, 1995

Related U.S. Application Data

[63] Continuation-in-part of Ser. No. 228,413, Apr. 15, 1994, Pat. No. 5,474,216.

[51] Int. Cl.[6] ..... D06C 15/00; D06F 69/02

[52] U.S. Cl. ..... 223/57; 223/52.1; 223/70; 223/52; 223/68; 38/10; 38/14; 38/6

[58] Field of Search ..... 223/57, 70, 71, 223/68, 69, 52, 52.1, 52.2, 52.3, 52.4, 52.5, 52.6; 38/10, 14, 16

[56] References Cited

U.S. PATENT DOCUMENTS

| | | | |
|---|---|---|---|
| 1,682,488 | 8/1928 | Davis | 223/52.1 |
| 2,059,295 | 11/1936 | Wilhelm | 223/52.1 |
| 2,834,523 | 5/1958 | Maywell et al. | 223/57 |
| 2,875,929 | 3/1959 | Langen et al. | 223/57 |
| 3,087,658 | 4/1963 | Davis | 223/52.1 |
| 3,463,367 | 8/1969 | Campbell et al. | 223/57 |
| 3,471,067 | 10/1969 | Stewart | 223/57 |
| 3,514,020 | 5/1970 | Lorritzo | 223/52.1 |
| 3,568,900 | 3/1971 | Paris | 223/70 |
| 5,474,216 | 12/1995 | Harrod et al. | 223/57 |

*Primary Examiner*—Bibhu Mohanty
*Attorney, Agent, or Firm*—Dominik & Stein

[57] ABSTRACT

A method and apparatus for pressing a shirt comprising a shirt buck having a front and a back and opposite lateral sides therebetween and adapted to hold at least the front and back of the shirt in an orientation for being pressed, drive means to laterally move the shire buck between a loading zone and a shirt finishing zone, and a pair of chests positioned adjacent to the shirt buck at the shirt finishing zone, the chests being movable in pressing contact with a shirt on the shirt buck. The method and apparatus further comprises a supplemental buck having a central section for receiving thereon the collar of a shirt to be pressed and, on opposite sides thereof a pair of lateral sections for receiving thereon the cuffs of a shirt to be pressed with mounting means to support the central and lateral sections for concurrent movement, a plurality of fixed platens including a central platen for receiving therebeneath the collar of a shirt to be pressed with the central section of the supplemental buck therebeneath and with a pair of laterally disposed platens for receiving therebeneath the cuffs of a shirt to be pressed with the lateral sections of the supplemental buck therebeneath.

3 Claims, 12 Drawing Sheets

METHOD AND APPARATUS FOR FINISHING THE SLEEVES AND PRESSING THE BODY OF A SHIRT IN COMBINATION WITH AN INTEGRATED COLLAR/CUFF PRESSER

RELATED APPLICATION

This is a continuation-in-part application of U.S. patent application Ser. No. 08/228,413, filed Apr. 15, 1994 now U.S. Pat. 5,474,216.

BACKGROUND OF THE INVENTION

1. Field of the Invention

This invention relates to a method and apparatus for finishing the sleeves and pressing the body of a shirt in combination with an integrated collar and cuff presser and, more particularly, to concurrently pressing the front and back of a shirt and finishing the sleeves through the use of common sources of steam and pressurized air in combination with an integrated presser for the collar and cuffs of the shirt, with all of the loading and unloading of the shirt being done at a common zone.

2. Description of the Background Art

Presently, in the field of finishing shirts, three separate machines are normally utilized. The first machine is for pressing the collars and cuffs. The second machine is for finishing the sleeves. The third machine is for pressing the body of the shirt. A continuing effort is being made to increase the efficiency of the shirt finishing process by minimizing the number of machines necessary for the finishing and by simplifying the machines. By way of example, consider U.S. Pat. No. 3,654,714 to North directed to a steam-air garment press; U.S. Pat. No. 3,679,106 to Beckett directed to a control system for garment finishing apparatus; U.S. Pat. No. 3,715,064 to Eubank directed to a garment finishing apparatus; U.S. Pat. No. 4,634,030 to Uchikoshi directed toward a laundry presser for simultaneously pressing multiple clothing sections; U.S. Pat. No. 4,843,745 to Oberlye directed toward a press and method of making same; U.S. Pat. No. 5,012,962 to Downie directed toward an indexing mechanism for a mannequin carriage having a slidable, pivotable support and index bar moveable by a fluid cylinder for movement between a dressing position and a garment press; and lastly, U.S. Pat. No. 5,065,535 to Gill directed toward an indexing system for rotary garment press.

Nothing in the prior art provides the benefits attendant with the present invention.

Therefore, it is an object of the present invention to provide an improvement which overcomes the inadequacies of the prior art devices and which is a significant contribution to the advancement of the art.

Another object of the present invention is to press the front and back of a shirt while concurrently finishing its sleeves as well as pressing the collar and cuffs of the shirt in an integrated system.

A further object of the present invention is to use a single source of air pressure for holding a shirt on a buck and for finishing the sleeves.

A further object of the present invention is to use valves to divert a constant flow of air between a positive source of pressure to a negative source of pressure.

A further object of the invention is to utilize a common zone for loading and unloading a shirt from a body buck as well as a collar and cuff buck.

It is a further object of the present invention to increase the efficiency, simplicity and safety of shirt finishing machines while reducing the cost through reduced equipment.

Lastly, it is an object of the present invention to provide a new and improved method and apparatus for pressing a shirt comprising a shirt buck having a front and a back and opposite lateral sides therebetween and adapted to hold at least the front and back of the shirt in an orientation for being pressed, the shirt buck also including an air and steam inlet and a vacuum outlet; drive means to laterally move the shirt buck between a loading zone and a shirt finishing zone; a pair of chests positioned adjacent to the shirt buck at the shirt finishing zone, the chests being movable between an inoperative position remote from the shirt buck and an operative position proximate to each other and the shirt buck and in pressing contact with a shirt on the shirt buck; drive means to laterally move the chests between the inoperative and operative positions; steam lines coupling the steam inlet to a supply of steam; a supplemental buck having a central section for receiving thereon the collar of a shirt to be pressed and, on opposite sides thereof a pair of lateral sections for receiving thereon the cuffs of a shirt to be pressed with mounting means to support the central and lateral sections for concurrent movement; a plurality of fixed platens including a central platen for receiving therebeneath the collar of a shirt to be pressed with the central section of the supplemental buck therebeneath and with a pair of laterally disposed platens for receiving therebeneath the cuffs of a shirt to be pressed with the lateral sections of the supplemental buck therebeneath; drive means to shift the supplemental buck between the loading zone, the same as for the shirt buck, and a collar and cuffs pressing zone for moving a supported collar and cuffs of a shirt into pressing engagement with the fixed platens and for removing the supplemental buck away therefrom after pressing; and supplemental steam lines coupling the supply of steam to the collar and cuffs pressing zone.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a method and apparatus for concurrently pressing the front and back of a shirt and finishing the sleeves and for pressing the collar and cuffs of the shirt through the use of common sources of pressurized air and steam comprising, in combination a shirt buck in the general form of a wearer having a front and a back and opposite lateral sides therebetween and adapted to hold at least the front and back of the shirt in an orientation for being pressed, the shirt buck also including an air and steam inlet and a vacuum outlet; first drive means to laterally move the shirt buck between a loading zone and a shirt finishing zone; a pair of chests positioned adjacent to the shirt buck at the shirt finishing zone, the chests being movable between an inoperative position remote from the shirt buck and an operative position proximate to the shirt buck and in pressing contact with a shirt on the shirt buck; second drive means to laterally move the chests between the inoperative and operative positions; a pair of clips, the clips including elongated generally vertical arms positioned on the opposite lateral sides of the shirt buck and movable therewith between the shirt loading and finishing zones, the lower ends of the arms being supported for independent rotation toward the lateral sides of the shirt buck and away therefrom, the clips being formed with resiliently urged fingers at their upper ends and adapted to receive an area of a shirt on the shirt buck to be finished at the region between the cuff and sleeve to form an obstruction for the flow of heated air and steam therethrough during a finishing operation; third drive means with an actuation pedal to retain the clips toward each other adjacent to the opposite lateral sides of the shirt buck when the shirt buck is in the loading zone and to retain the clips away from each other and the shirt buck when the shirt buck is in the shirt finishing zone; steam lines (1) for coupling a reservoir of steam with a steam nozzle adjacent to the shirt buck for live steam to be utilized during the finishing operation, (2) a heat exchanger over which air moving to the shirt buck will pass, (3) in closed loops to the chests and (4) coupling the steam inlet to a supply of steam; air lines for coupling a source of air pressure and the shirt buck to draw a vacuum through the shirt buck when the shirt buck is in the loading zone for holding a shirt against the shirt buck and to provide a positive air pressure to the interior of the shirt buck when the shirt buck is in the finishing zone to force the sleeves outwardly to effect their finishing; a single blower coupled to a positive pressure chimney and a negative pressure chimney and to the shirt buck with associated control mechanisms to alternately apply positive air pressure to the shirt buck when in the finishing zone and negative air pressure when the shirt buck is in the loading zone; a supplemental buck having a central section for receiving thereon the collar of a shirt to be pressed and, on opposite sides thereof, a pair of side sections for receiving thereon the cuffs of a shirt to be pressed with mounting means to support the central and lateral sections for concurrent movement; a plurality of fixed platens including a central platen for receiving therebeneath the collar of a shirt to be pressed with the central section of the supplemental buck therebeneath and with a pair of side platens for receiving therebeneath the cuffs of a shirt to be pressed with the side sections of the supplemental buck therebeneath; fourth drive means to shift the supplemental buck generally horizontally between an intermediate zone and the loading zone, the same as for the shirt buck; fifth drive means to move the supplemental buck generally vertically between the intermediate zone and a collar and cuffs pressing zone thereabove for thereby raising a supported collar and cuffs of a shirt into pressing engagement with the fixed platens and for lowering the supplemental buck away therefrom after pressing; and supplemental steam lines coupling the supply of steam to the supplemental buck and fixed platens when the collar and cuffs are being pressed therebetween.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
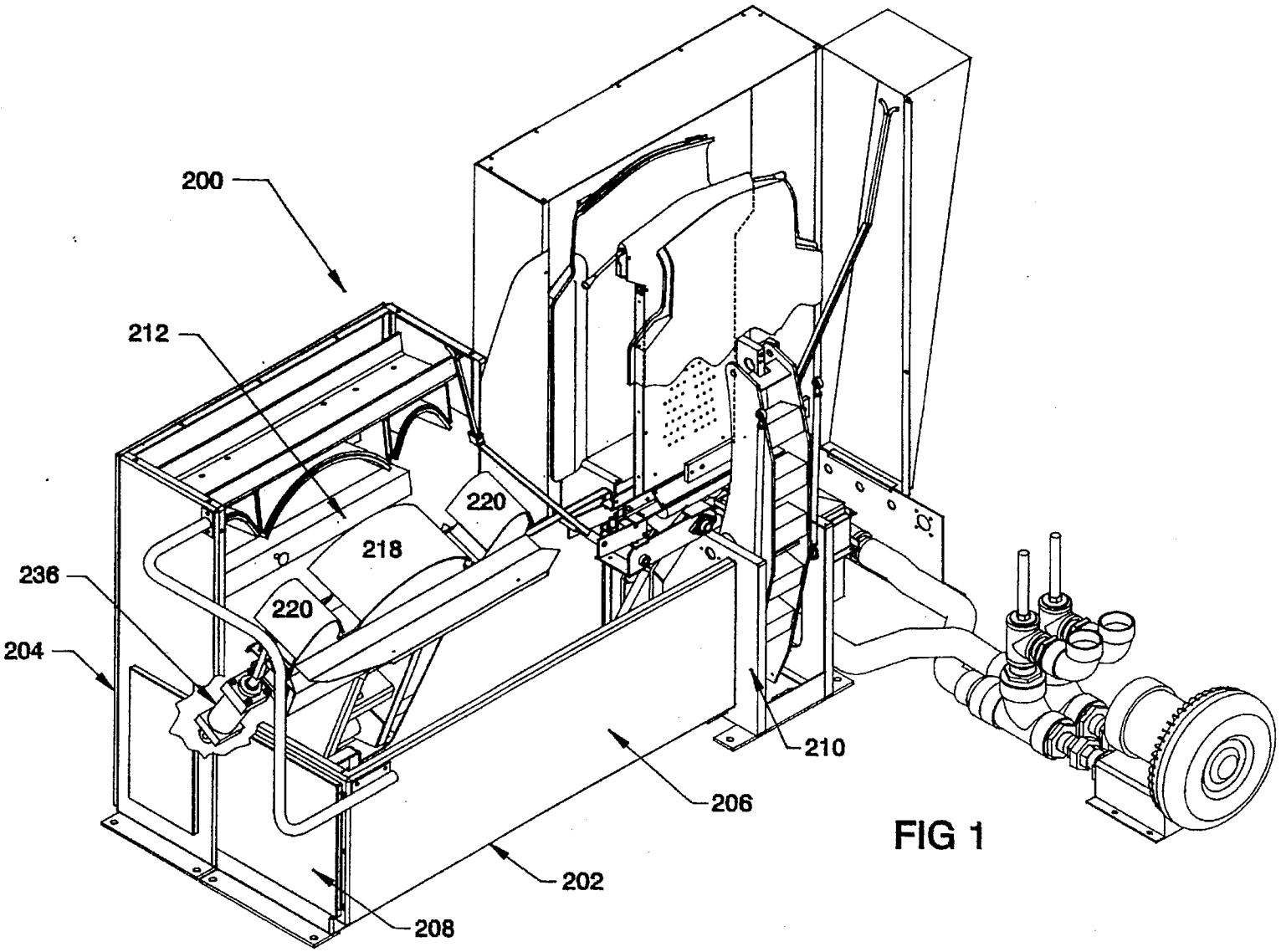
FIG. 1 is a perspective illustration of an alternate embodiment of the invention showing the new and improved method and apparatus for finishing the sleeves and pressing the body of a shirt in combination with an integrated collar/cuff presser with parts broken away to show certain internal constructions thereof.
Figure 2:
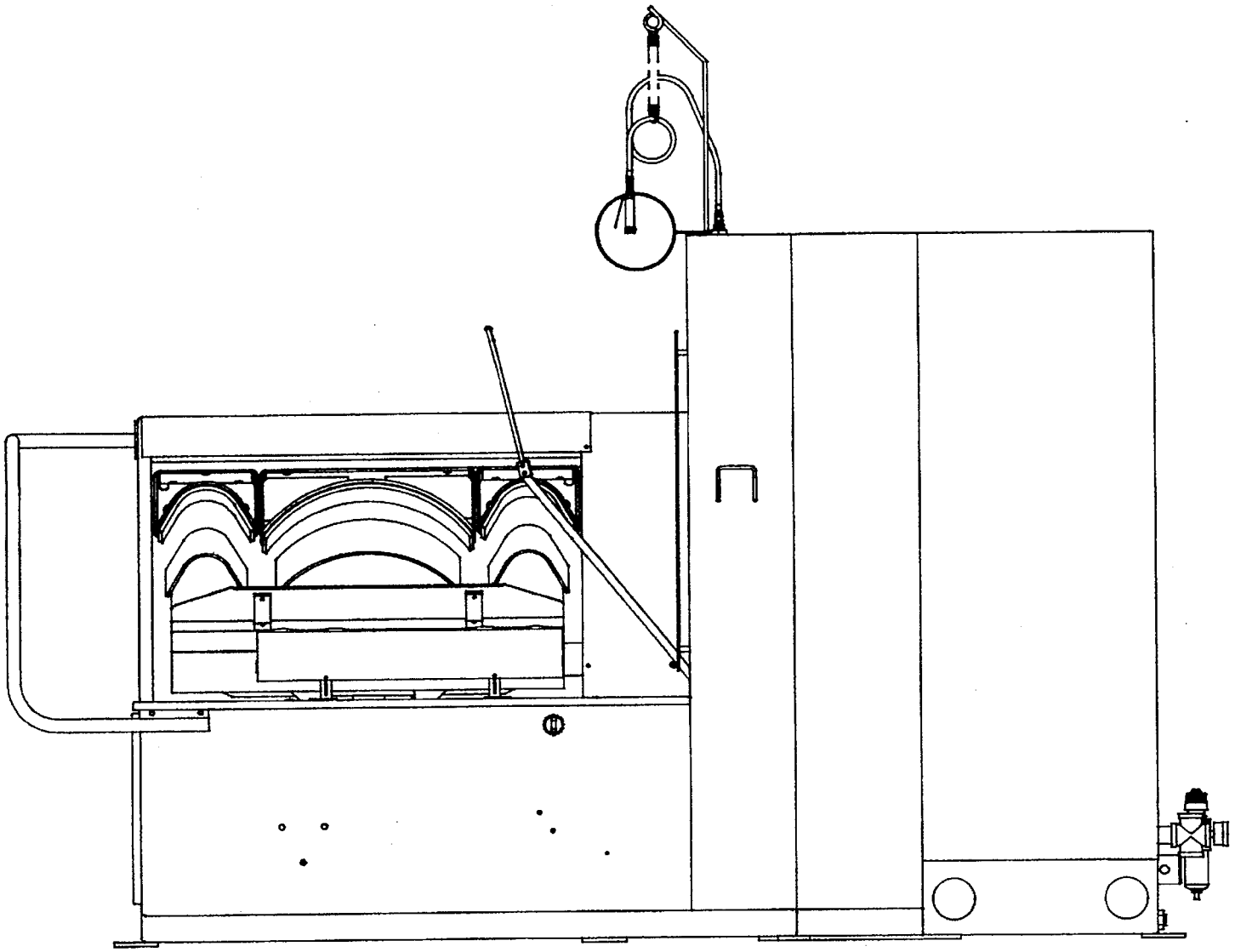
FIGS. 2 and 3 are a front and top elevational view of the apparatus of the system shown in FIG. 1.
Figure 3:
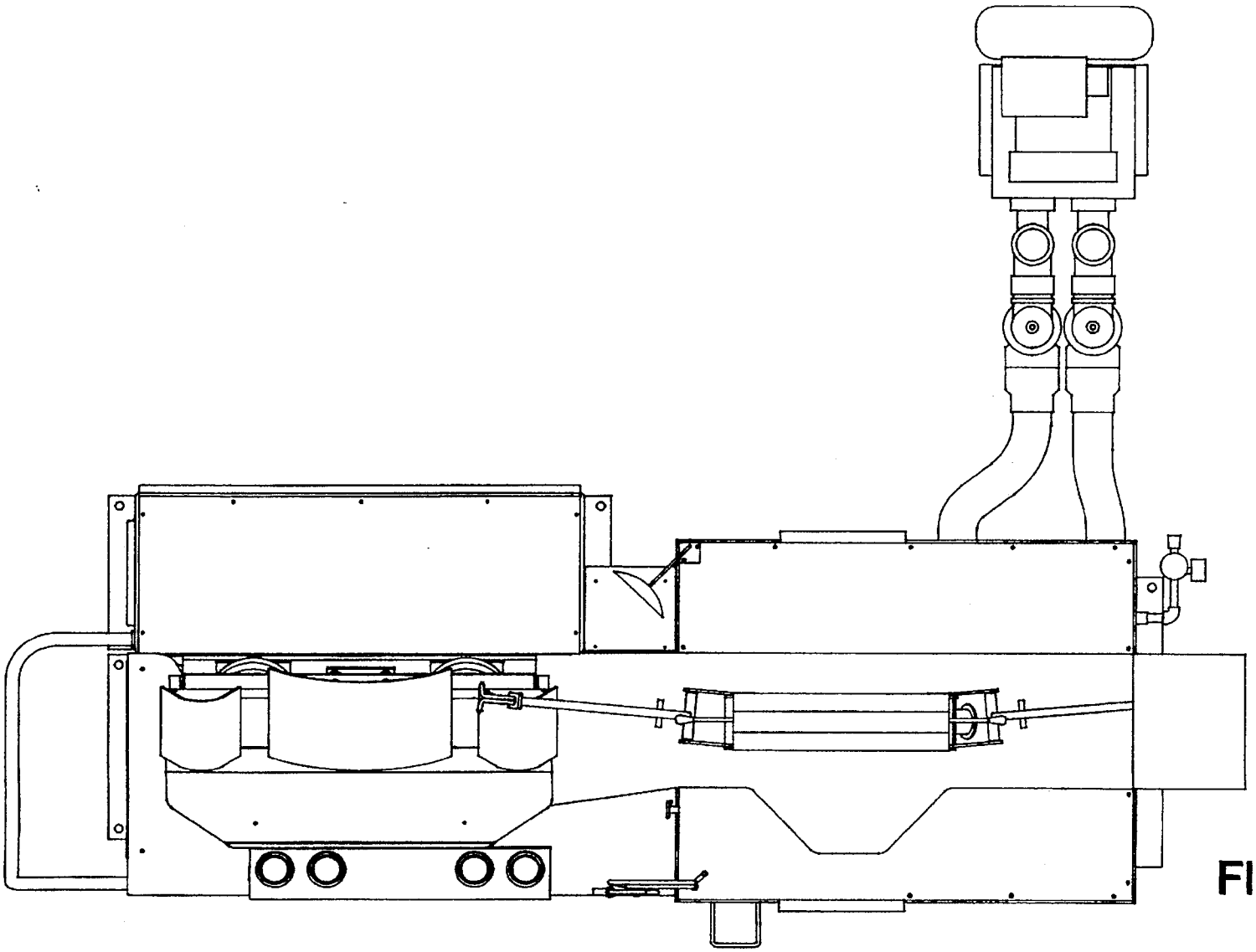
Figure 4:
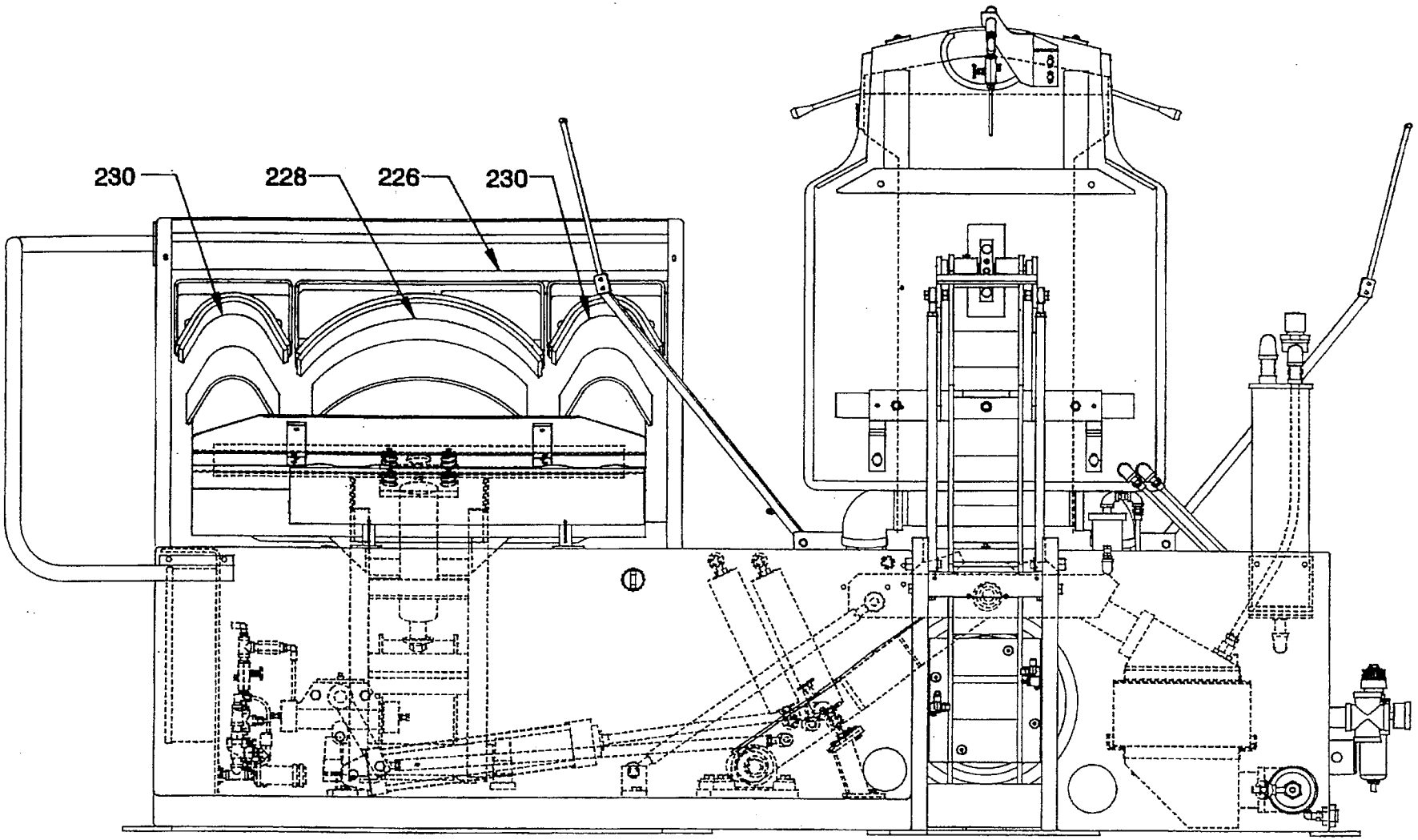
FIGS. 4 and 5 are a front and top elevational view similar to FIGS. 2 and 3 but with covers removed for illustrating certain internal constructions thereof.
Figure 5:
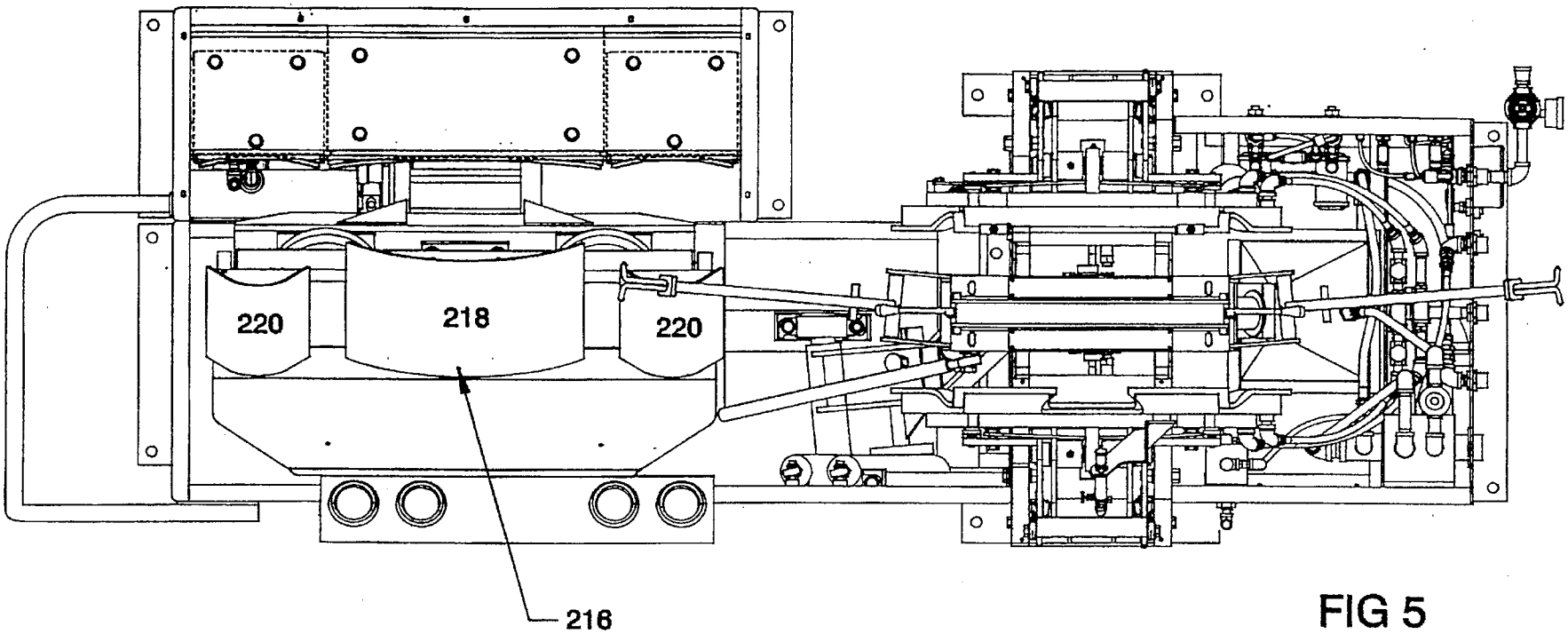

In our prior invention, we patented an apparatus for pressing the body of a chirr and finishing the sleeves. In this embodiment, we have invented additional apparatus for pressing the collar and cuffs of the shirts that is fully integrated with our patented apparatus. More specifically, our patented apparatus for pressing the body of a shirt and finishing the sleeves has as its main component a buck. The buck is in the general form of a wearer of a shirt. The buck has a contoured front and a contoured back and opposite lateral sides therebetween. The buck is adapted to hold at least the front and back of the shirt to be finished in an orientation for being pressed.

The buck is mounted from beneath by parallel arms for lateral movement between a loading zone and a finishing zone. The buck has a clamp 26 in the neck area for the collar of the shirt to be pressed. The buck also has two short shoulder rods. Such shoulder rods are for holding the shoulders of the shirt in proper orientation during the finishing operation.

Also provided on the buck are a pair of arm clips. These clips are for receiving the cuffs of the sleeves of the shirt to be pressed. The clips receive the area of the shirt sleeve where the end of the sleeve and cuff join. The clips function so that during the finishing operation, a sealing function occurs.

More particularly, the clips include elongated generally vertical arms positioned on the opposite lateral sides of the buck. They are moveable with the buck between the loading and finishing zones. The lower ends of the arms are supported by pins for independent rotation toward the lateral sides of the buck and away therefrom. The clips are formed with resiliently urged fingers at their upper ends. These fingers are adapted to receive the appropriate area of the shirt on the buck to be finished. They form an obstruction for the flow of heated air and steam therethrough during the finishing operation to effect an appropriate finishing of the shirt.

A blower is provided for the apparatus. The blower is for directing a flow of ambient air with respect to the apparatus in one path or the other. More specifically, it draws air through the buck in a vacuum mode when the buck is in the loading orientation. It feeds air to the buck to a assist in finishing a shirt when the buck is in the finishing zone.

An impeller within the blower, not shown, always rotates in the same direction to provide different directions of air flow. There are two chimneys and. When the buck is in the loading zone, a vacuum is desired to hold the shirt onto the buck. In this orientation, as will be described later, the valves are oriented to close off the first chimney but to allow a vacuum to be drawn through the buck and exhausting to atmosphere. When the buck is in the finishing operation, the valves are reversed to effect a flow of positive air pressure from the atmosphere through its associated chimney and into the buck.

Associated mechanisms for the finishing operation are provided with the apparatus. These include a spray gun for moistening the shirt in areas if and when needed. Also included is a mirror on the reverse side of the apparatus to increase the operator's visibility of the activities.

Operable in association with the buck during the pressing operation at the finishing zone are a pair of similarly shaped chests. The chests are of a similar construction and are adapted to be heated through a flow of steam therethrough. They have interior surfaces contoured to mate with the contour of the adjacent contour of the buck. The chests are mounted on supports. The lower ends of the supports are pivoted to move the chests perpendicularly with respect to the movement of the chests between an inoperative position remote from the buck and an operative position. In the operative position the chests are closer to each other and close to the buck in pressing contact with a shirt on the buck being finished. Second drive means are provided to move the chests between the inoperative and operative positions.

The steam for the various finishing activities is received from a reservoir. The reservoir is replenished from a remote source of steam, not shown, to which it is coupled. In association therewith is a filter vat for high pressure air inlet. Three outlets, are provided adjacent the steam inlet. Once the steam enters the apparatus, it is diverted through a manifold to three locations. The manifold distributes the steam to the front and rear chests to effect their heating. Steam is directed to a heat exchanger so that air may pass thereover for being heated as it is moved to interior of the buck for finishing. Lastly, steam is provided to a reservoir as described above for being conveyed into the sleeves through a line in the air flow line during the finishing operation.

A flow of steam is directed into the air flow line of the buck for finishing. A flexible tube conveys air from the buck through the blower for the vacuum hold-down function at the loading zone. Further, a short line is inoperative when the buck is at the loading zone. When, however, the buck moves to the finishing zone, the free end couples with an associated line for closing purposes. Such closing allows air to be directed from the blower, over the heat exchanger and into the buck. A line is provided for adding steam to the finishing air when the buck is at the finishing zone. A baffle is positioned within the buck to provide a first upper zone for the finishing steam and hot air and a smaller zone for the vacuum holding the shirt in position at the loading zone.

More specifically, the vacuum chamber of the buck includes a metallic member interior of the buck. Such member is provided with a plurality of air holes. This is the area where ambient air is drawn from interior of the buck to the blower for holding the shirt without additional mechanical hold-down components.

In the blower, air comes in from the right side through the blower and out the left side. When the apparatus is activated in anticipation of a finishing cycle, air is being continually circulated in one chimney and out the other. Air comes in from the lower right and is sucked in by the blower at the lower left. In association therewith, there is a lower large T and above that an upper smaller T These couple the chimneys to the blower and functioning components of the apparatus. In association therewith, there is an air cylinder above each upper T. Connected to the air cylinder is a plunger that moves up and down within the smaller T in which it is located. This opens or closes the air flow to its associated chimney. These three plungers function as valves to control independently the flow of air to the apparatus from its associated chimney. Various types of blowers may be utilized for the desired functions. A preferred blower is a SPENCER VORTEX Blower. Such blowers are the product of the Spencer Turbine Company of Windsor, Conn. The preferred sizes are 4 horsepower or 7½ horsepower as a function of the size of the voltage cycles.

The central processing unit for the apparatus is a control box. In association therewith are two operator control regions. The first is a hand button panel and an associated foot switch. When the buck is in the loading position and the foot switch is depressed, the vacuum is turned on to the buck and the arm clips are expanded. When the two laterally spaced hand buttons are depressed by an operator, the buck will move from its loading zone into the finishing zone.

The second operator control region is the switch box assembly. The switch box assembly has buttons to power on/off B- and, start the blower, an alternate time sequence for the system and warning lights and buzzer and. Also included is an emergency stop button.

Coming out of the control box are a plurality of lines. The first line, which couples to the hand button panel. This is coupled with respect to the steam valve as a manual shut-off switch to inhibit the steam valve from being automatically energized during the normal cycle of operation.

The second line, goes to the switch box assembly, which is the primary off/on control for the overall system. The third line, goes to the valve bank for controlling the pneumatic cylinders for positive pressures to the drive mechanisms and to the diverter valves for all pneumatic cylinders of the system. The fourth line, goes to the switch box assembly for controlling all the other function in the switch box except for the off/on. The fourth line also operates and controls the front safety bar, not shown. Safety bars are generally vertical bars adjacent to the buck which, if inadvertently contacted by an operator, would reverse the motion of the buck for operator safety. The fifth line, goes to the hand button panel for the foot switch to coordinate its operation. Line couples to the hand buttons of the hand button panel. The sixth line, goes up to the rear safety bar, which performs a function similar to the front safety bar but on the opposite side of the apparatus. Also controlled from the sixth line are two micro-switches, a head closed switch and a rear head open switch, and the vacuum and pressure air valves as well as the control valve, front head open.

The micro-switch functions to contact the chest arms to verify that the intended timing sequence is being followed during the opening and closing of the chests with respect to the buck.

The vacuum air valve and the pressure air valve are those valves associated with the blower to ensure proper sequencing for controlling plungers of the diverter valve for the blower. The control valve is for verifying the proper orientation of the chests during the operating cycle.

The eighth line, controls the transfer cylinder. On the transfer cylinder are three reed switches. These switches tell whether the buck is in the loading zone, the finishing zone, or a neutral zone therebetween.

Coming off the switch box assembly to the air steam frame is the blower enable able. This operates with the blower on/off of the switch box assembly to a junction box adjacent to the blower for energizing and de-energizing the blower which in effect runs all the time during the operation of the system. The valves and diverters are utilized for changing its mode at various times through the cycle.

The filter regulator controls the quantity and the cleanliness of the air and it maintains proper pressure. Two exhaust ports are utilized.

This is the high pressure air for actuating the various pneumatic valves throughout the system. This is not to be confused with the low pressure air generated by the blower for drawing vacuum in the buck and for finishing the sleeves.

The valve is for the control of the buck transfer cylinder. This is for movement between the loading and finishing zones. Valve 2 controls the buck arms for moving the clips into closeness or remoteness of the buck through cylinder. Valve 3 controls inflation of the air bags on the side of the buck for finishing the sides of the shirt.

Valve 4 goes to the safety valves which are mounted to the transfer cylinder. These are energized when a transfer of the buck is initiated. They are de-energized at the end of the squeeze cycle effected by the chests. Valve 5 is for a vacuum diverter valve. Valve 6 also closes the chests to the squeeze against the buck. Also off of valve 6 is a sequencer which will detect the appropriate closing of the chests with respect to the buck and allow the filing of the side air bags on the buck. Also off of valve 6 is a collar clamp opener 126. The collar clamp is manually placed into position when the buck is in the loading position with the collar of the shirt appropriately located on the buck. After the finishing and pressing cycle have been completed and the chests move away from the buck, the collar clamp is opened. Valve 7 controls the pressure diverter.

The sequence of operation involves three major functions, operator input to transfer the buck in from the loading zone to the finishing zone, the squeeze cycle whereat the shirt body is pressed and its sleeves are finished, and the transfer out wherein the buck is moved from the finishing zone to the loading zone.

The first part of the cycle involves an operator pressing the foot switch momentarily. Thereafter valve 2 is energized to extend the sleeves and valve 5 is energized to turn on the vacuum to the buck. Thereafter, if the foot switch is depressed a second time, valves 2 and 5 are de-energized. The foot switch may be depressed as many times as required before a transfer is to be initiated. Valves 2 and 5 must be energized before a transfer is allowed. With valves V-2 and V-5 energized, transfer hand buttons one and two are depressed to transfer the buck. At this time, valves 1A and 4, transfer enable, are energized to move the buck into the finishing zone, the squeeze position. During the transfer cycle, the warning lamp is illuminated. The buck out switch is de-activated, the buck center switch is momentarily activated and the buck in switch is activated. The center of the three hand buttons is for cancel of buck movement or the squeeze cycle in the event of an emergency.

For the squeeze cycle at the finishing zone, the buck in switch is activated. Valve 6 is energized to close the pressing heads, and the transfer warning lamp is turned off. Thereafter, the head closed switch is activated. In response thereto, the steam valve is energized for about four seconds through the fixed timer, valve 7 is energized to allow hot air to the buck, valve 5 is de-energized to open the dump valve and turn off the vacuum and the squeeze timer is activated through its normal controlled sequence. Thereafter, the squeeze timer is timed out whether done normally or abnormally, valve number 6 is de-energized to open the heads, the counter is activated. Next the head closed switch is de-activated whereby valve 1A is de-energized and valve 4 is de-energized. Lastly, the head open switch is activated whereupon valve 7 is de-energized to stop the sleeve air and the steam valve is de-energized if not already timed out.

The last part of the sequence is the transfer out. This begins with the head open switch being activated whereby valve 1B and valve 4 are energized to return the buck to the out or loading position while the transfer warning lamp and transfer warning buzzer are activated. Thereafter, the buck center switch is activated momentarily and valve 2 is de-energized to close the sleeve extenders. Lastly, the buck one out switch is activated whereby valve 1B and valve 4 are de-energized and the transfer warning lamp and transfer warning buzzer are turned off.

Now referring to the drawings of FIGS. 1–12 there is added to the apparatus for pressing the body of a shirt and finishing the sleeves, additional apparatus for pressing the collar and cuffs of the shirt. Such additional apparatus is integrated with the previously described apparatus through common steam and air lines for providing the steam and air pressure for effecting the pressing of the collar and cuffs of a shirt and for effecting the moving of the pressing apparatus between the inoperative loading position and the operative pressing position. Controls, including safety controls, are provided for commonly operating the various components of the overall system.

More specifically, in the system 200 of the alternate embodiment, the frame 202 of the first embodiment is formed into an extended configuration positioned upon a support surface such as the floor of the laundry. Extending upwardly from the base are panels including a rear panel 204, a front panel 206 and side panels 208, 210. One side panel 210 forms a part of the panel of the apparatus of the prior disclosed embodiment. Within such panels and above such base are the operative components for the collar and cuffs pressing apparatus 212.

The operative components for the collar and cuffs pressing apparatus includes a supplemental buck 216. Such supplemental buck has a central section 218 for receiving thereon the collar of the shirt to be pressed. On opposite sides of the central section are a pair of similarly configured side sections 220. The side sections and central section are curved in the conventional manner for allowing the appropriate pressing action. The upper surfaces of the central and side sections are for receiving the collar and cuffs respectively. Such central and side sections are provided on a mounting member 222. Such mounting member supports thereabove on its upper surface the central and side sections for concurrent movement as will be later described.

In association with the supplemental buck is a platen assembly 226. The platen assembly incudes a plurality of fixed platens. Such fixed platens include a central platen 228 for receiving therebeneath the collar of the shirt to be pressed. When pressing, the central section of the supplemental buck is in pressing engagement therebeneath. The platen assembly also includes a pair of similarly shaped side platens 230. Such side platens are for receiving therebeneath the cuffs of a shirt to be pressed concurrently with the collar. When being pressed, the side sections of the supplemental buck are therebeneath with the collar with the fixed platens thereabove.

In association with the apparatus for pressing the collar and cuffs are drive mechanisms 234 for shifting the supplemental buck. Such drive mechanisms include a piston 236 pivotally coupled at its lower end 238 to the frame 240 of the machine. The upper end 242 of such piston is pivotally coupled to a lower component 244 of the supplemental buck assembly. Such piston is adapted to shift the supplemental buck assembly generally horizontally with a slight arc, the center of which is at the lower pivot point of the piston. The loading zone for the collar/cuff buck assembly is at the same location as the loading zone for the shirt buck as previously described.

The final drive means 250 is in the nature of a pair of similarly shaped diaphragms 252. Such diaphragms are spaced laterally side by side beneath the upper component 254 of the supplemental buck assembly. Such diaphragms are located between a lower component 244 of the supplemental buck assembly and an upper component 254 of the supplemental buck assembly. Such diaphragms are of an air impervious elastomeric material and are adapted to concurrently receive pressurized air from the supply of air for inflation purposes. When so inflated, the upper component of the supplemental buck assembly will rise generally vertical to an elevated pressing zone in close proximity to the associated fixed platens to press the collar and cuffs of a shirt previously positioned upon the central and side sections of the supplemental buck.

Lastly, from a structural standpoint, there are provided supplemental steam lines 260, 262 coupling the supply of steam 264 to the supplemental buck and fixed platens. Such supply of steam is to these regions of the collar and cuffs platens and supplemental buck sections for pressing purposes when the collars and cuffs are being pressed between such supplemental buck sections and the fixed platens.

Figure 6:
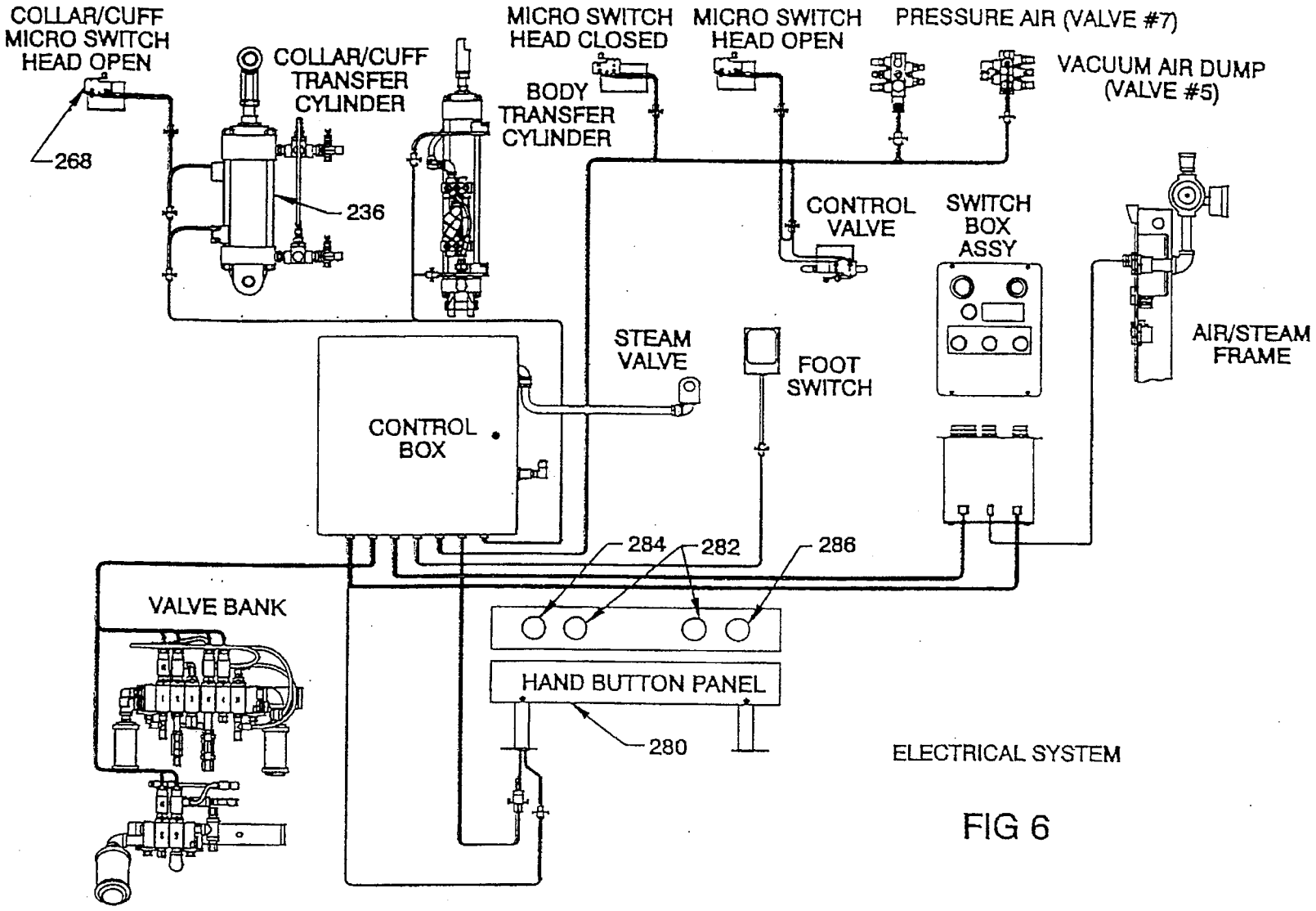
FIG. 6 is a schematic illustration of the electrical system for the apparatus shown in FIG. 1.

With reference to FIG. 6, the electrical system schematic, are valves 8 and 9. Such valves function to control the motion-imparting pressurized air to the collar and cuffs transfer piston or cylinder 236. Such is shown in the upper left of FIG. 6. In proximity to the collar/cuff transfer cylinder 236 is a collar/cuff micro switch-head open 268. Such switch is to provide controls by identifying when the supplemental buck assembly is at the intermediate position to thereby allow for continuing the motion of the supplemental buck, either to continue its motion from the loading zone to the intermediate zone and then the pressing zone or, in reverse, from the pressing zone to the intermediate zone and then to the loading zone.

Figure 7:
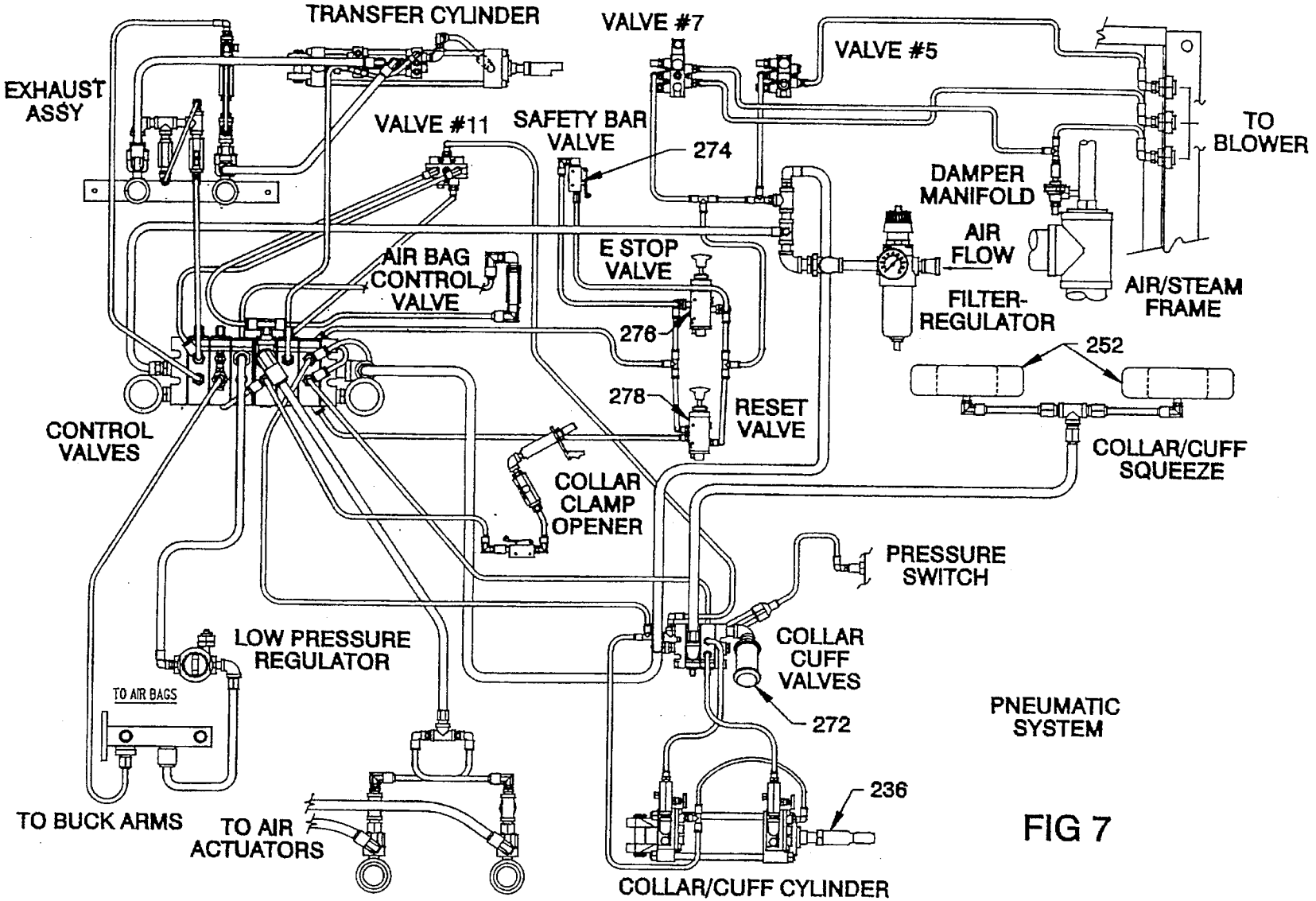
FIG. 7 is a schematic illustration of the pneumatic system of the apparatus shown in FIG. 1.
Figure 8:
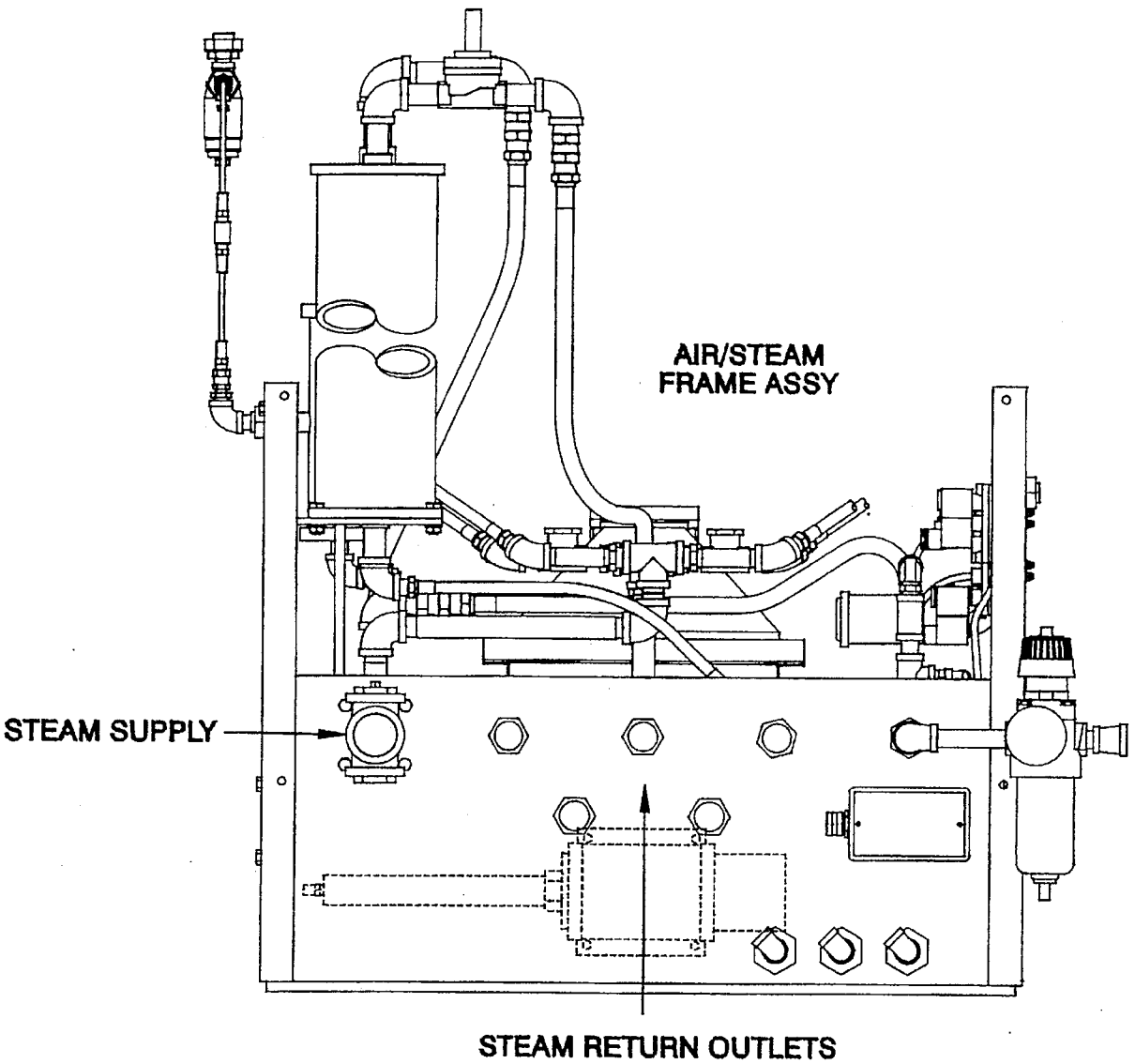
FIGS. 8 and 9 are a side and top elevational view of the air/steam frame assembly with parts broken away to show certain internal constructions thereof.
Figure 9:
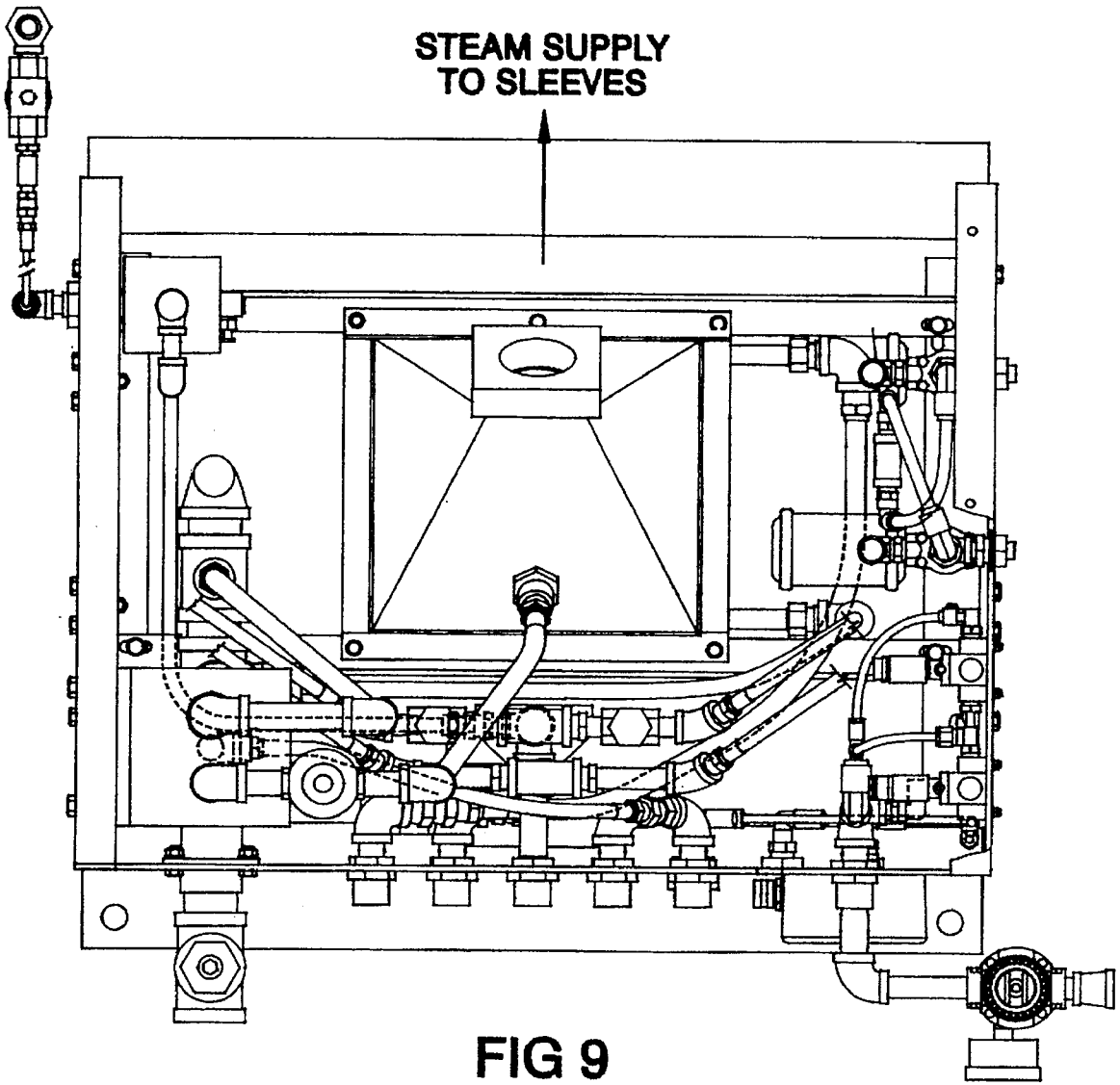
Figure 10:
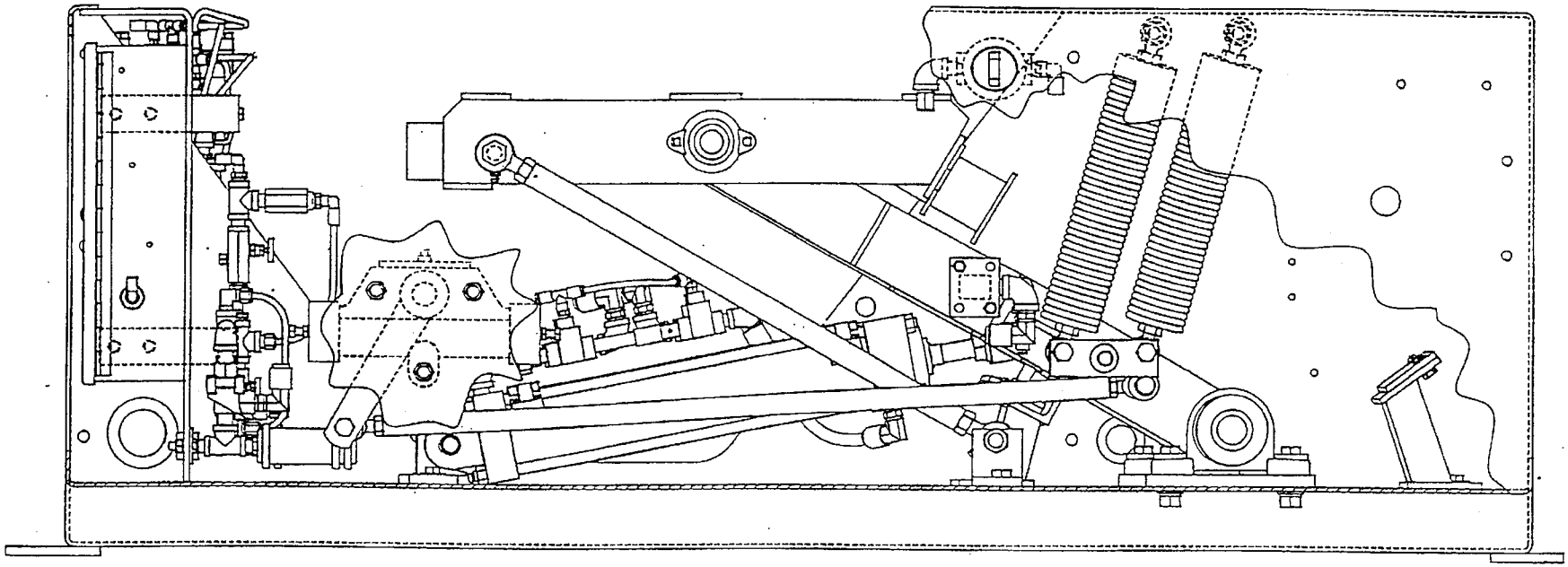
FIGS. 10 and 11 are a front and top elevation view of the buck transfer assembly once again with parts removed to show certain internal constructions thereof.
Figure 11:
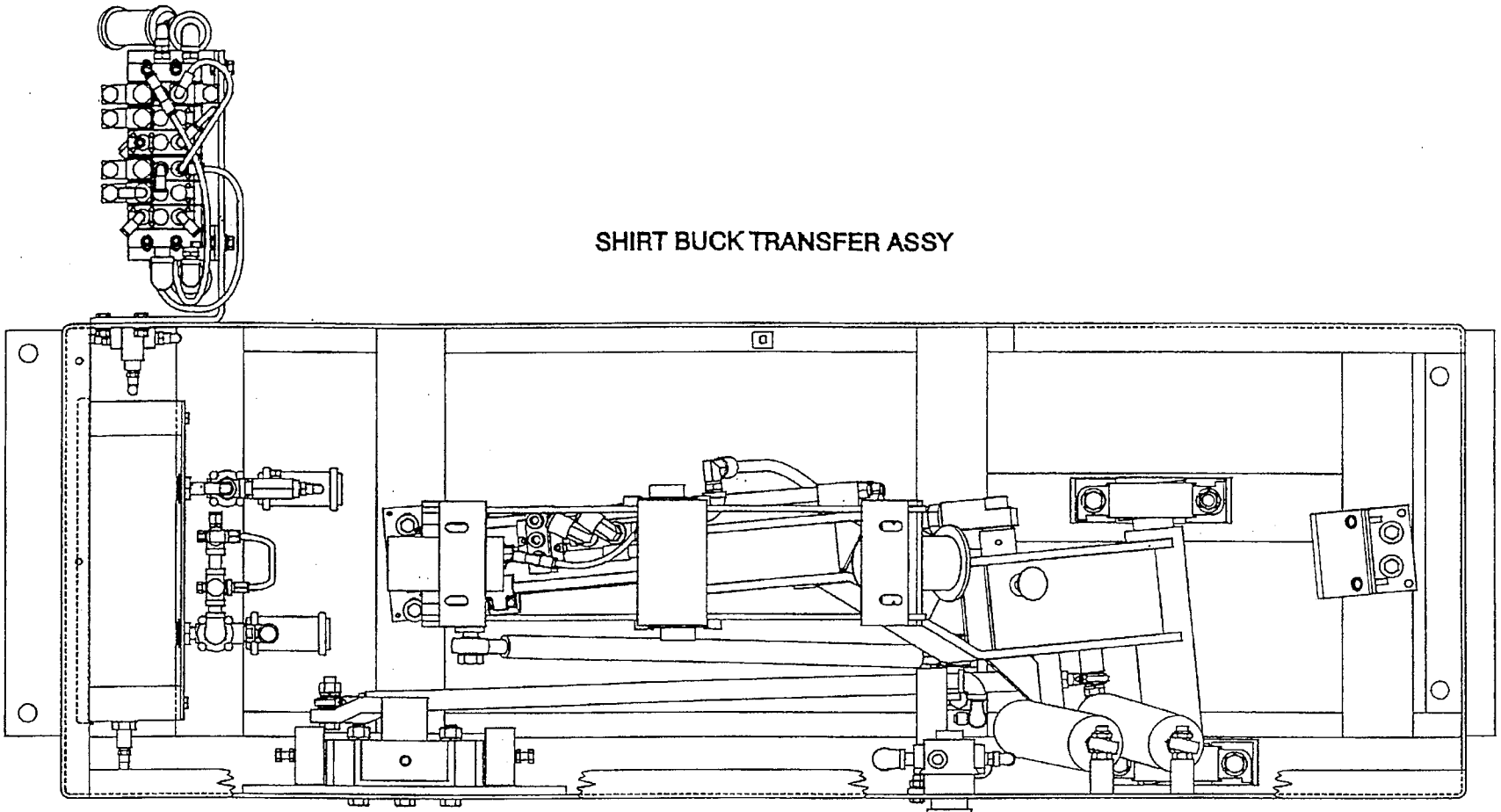
Figure 12:
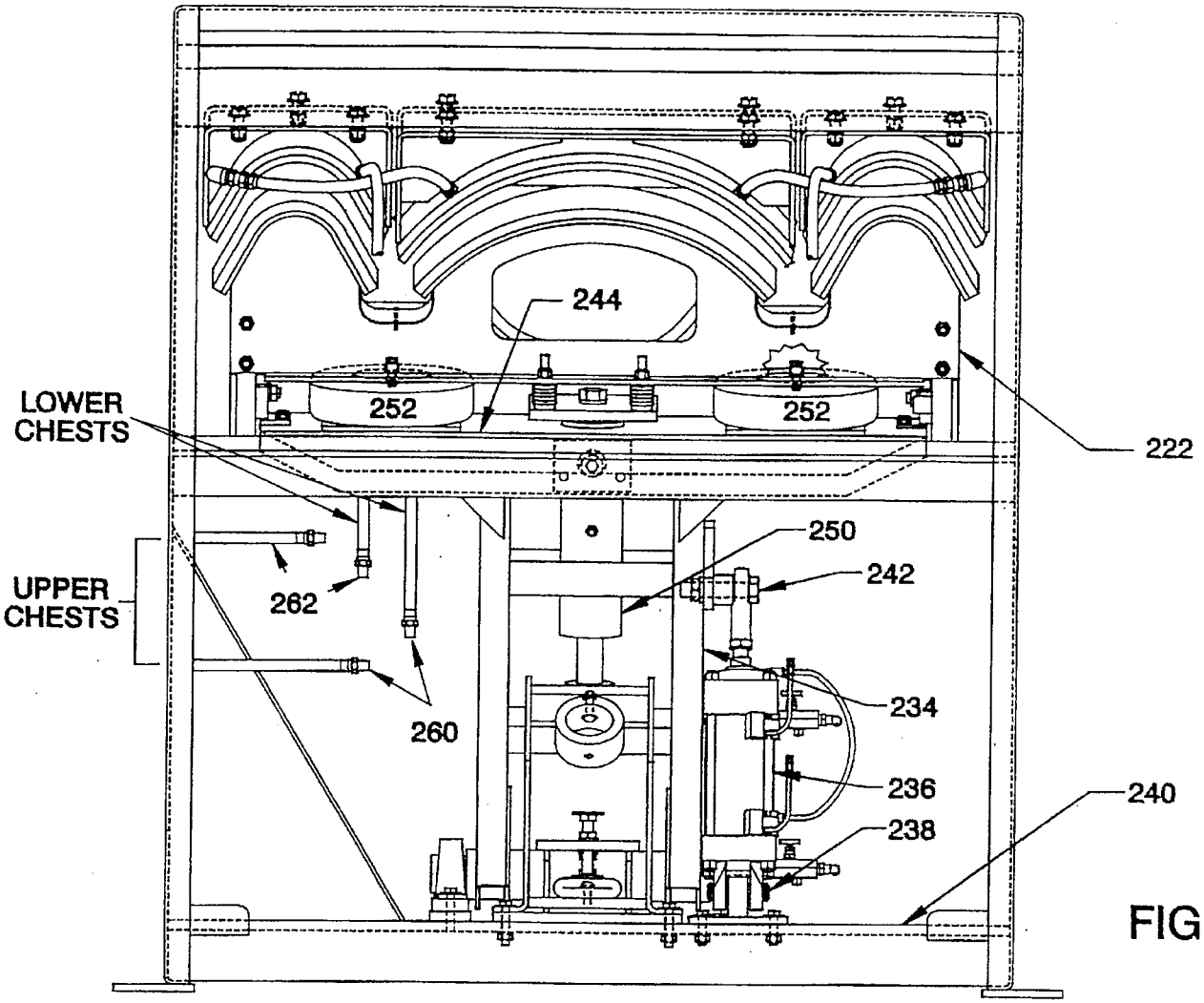
FIG. 12 is a front elevational view of the collar/cuffs transfer assembly with parts removed to show certain internal constructions thereof.

With regard to the pneumatic system as shown in FIG. 7, there is provided the collar/cuff cylinder 236 to effect the essentially horizontal motion of the supplemental buck between the loading and intermediate position. In addition, the collar/cuff valves 272 are provided for diverting the pressurized air to the collar/cuff squeeze diaphragms 252 described above to effect the proper cycle of operation. Note is also taken that in the prior embodiment, the safety bar valve 274, the emergency stop valve 276 and the reset valve 278 are converted to pneumatic valves rather than the electrical valves as used in the prior embodiment.

The operator hand button control panel 280 is located immediately in front of the loading zone which is the same for the shirt buck as well as the collar and cuffs buck. Operator movement is thus abated during operation and use of the system. Such control panel includes two central go buttons 282 which, when pressed simultaneously, will initiate the movement of the shirt buck on its path of movement for pressing and finishing a shirt body and sleeves as described above. Two cancel buttons 284 and 286 may be individually pressed to cancel the cycle of operation of either the shirt buck or the collar and cuffs buck.

A normal cycle of operation begins with the loading of a first shirt on the collar and cuffs buck. The two go buttons 282 are simultaneously pressed to move the collar and cuffs buck from the loading station to the pressing station for pressing. The operator will wait until such shirt comes out and stops at the intermediate zone. The first cancel button 284 is then pressed to move the collar and cuffs buck to the loading zone. Such first shirt is then removed from the collar and cuffs buck and hung at an intermediate location for a temporary period. The operator then loads a second shirt on the collar and cuffs buck and once again hits the two go buttons 282. While the second shirt is having its collar and cuffs pressed, the second cancel button 286 is pressed to bring the body buck to the loading zone. At this time, the first shirt is loaded onto the body buck and the operator then presses the two go buttons 284 to press the body and finish the sleeves of the first shirt. At this time, the second shirt moves into the intermediate zone with its collar and cuffs pressed. The first cancel button 282 is then pressed and the collar and cuffs buck comes out to the loading zone whereat the second shirt is removed and hung temporarily. Shirt three is then loaded on to the collar and cuffs buck and the two go buttons are pressed to effect its finishing. At this time the second cancel button 286 is pressed to bring a fully pressed and finished shirt, shirt one, to the loading zone for being hung on a final hanger. Shirt two is then placed on the shirt buck and the two go buttons are pressed and the cycle is then continued.

The present invention includes the apparatus as described above as well as the method for concurrently pressing the front and back of a shirt and finishing the sleeves through the use of a single source of air pressure. The method includes the steps of providing the apparatus as described above as well as using such apparatus in the manner as described above. The method also includes the step of applying positive air pressure to the buck when in the finishing zone and applying negative air pressure when the buck is in the loading zone, the applying being effected from a single blower and associated valves and controls. The method also includes the steps of providing a supplemental buck having a central section for receiving thereon the collar of a shirt to be pressed and, on opposite sides thereof a pair of lateral sections for receiving thereon the cuffs of a shirt to be pressed with mounting means to support the central and lateral sections for concurrent movement; providing a plurality of fixed platens including a central platen for receiving therebeneath the collar of a shirt to be pressed with the central section of the supplemental buck therebeneath and with a pair of laterally disposed platens for receiving therebeneath the cuffs of a shirt to be pressed with the lateral sections of the supplemental buck therebeneath; providing a drive means to shift the supplemental buck between the loading zone, the same as for the shirt buck, and a collar and cuffs pressing zone for moving a supported collar and cuffs of a shirt into pressing engagement with the fixed platens and for removing the supplemental buck away therefrom after pressing; providing supplemental steam lines coupling the supply of steam to the collar and cuffs pressing zone; and activating the various drive means in a cycle of operation to press a shirt body and collar and cuffs.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. Apparatus for concurrently pressing the front and back of a shirt and finishing the sleeves and for pressing the collar and cuffs of the shirt through the use of common sources of pressurized air and steam comprising, in combination:

a shirt buck in the general form of a wearer having a front and a back and opposite lateral sides therebetween and adapted to hold at least the front and back of the shirt in an orientation for being pressed, the shirt buck also including an air and steam inlet and a vacuum outlet;

first drive means to laterally move the shirt buck between a loading zone and a shirt finishing zone;

a pair of chests positioned adjacent to the shirt buck at the shirt finishing zone, the chests being movable between an inoperative position remote from the shirt buck and an operative position proximate to the shirt buck and in pressing contact with a shirt on the shirt buck;

second drive means to laterally move the chests between the inoperative and operative positions;

a pair of clips, the clips including elongated generally vertical arms positioned on the opposite lateral sides of the shirt buck and movable therewith between the shirt loading and finishing zones, the lower ends of the arms being supported for independent rotation toward the lateral sides of the shirt buck and away therefrom, the clips being formed with resiliently urged fingers at their upper ends and adapted to receive an area of a shirt on the shirt buck to be finished at the region between the cuff and sleeve to form an obstruction for the flow of heated air and steam therethrough during a finishing operation;

third drive means with an actuation pedal to retain the clips toward each other adjacent to the opposite lateral sides of the shirt buck when the shirt buck is in the loading zone and to retain the clips away from each other and the shirt buck when the shirt buck is in the shirt finishing zone;

steam lines (1) for coupling a reservoir of steam with a steam nozzle adjacent to the shirt buck for live steam to be utilized during the finishing operation, (2) a heat exchanger over which air moving to the shirt buck will pass, (3) in closed loops to the chests and (4) coupling the steam inlet to a supply of steam;

air lines for coupling a source of negative air pressure and the shirt buck to draw a vacuum through the shirt buck when the shirt buck is in the loading zone for holding a shirt against the shirt buck and to provide a positive air pressure to interior of the shirt buck when the shirt buck is in the finishing zone to force the sleeves outwardly to effect their finishing;

a single blower coupled to a positive pressure chimney and a negative pressure chimney and to the shirt buck with associated control mechanisms to alternately apply positive air pressure to the shirt buck when in the finishing zone and negative air pressure when the shirt buck is in the loading zone;

a supplemental buck having a central section for receiving thereon the collar of a shirt to be pressed and, on opposite sides thereof, a pair of side sections for receiving thereon the cuffs of a shirt to be pressed with mounting means to support the central and lateral sections for concurrent movement;

a plurality of fixed platens including a central platen for receiving therebeneath the collar of a shirt to be pressed with the central section of the supplemental buck therebeneath and with a pair of side platens for receiving therebeneath the cuffs of a shirt to be pressed with the side sections of the supplemental buck therebeneath;

fourth drive means to shift the supplemental buck generally horizontally between an intermediate zone and the loading zone, the same as for the shirt buck;

fifth drive means to move the supplemental buck generally vertically between the intermediate zone and a collar and cuffs pressing zone thereabove for thereby raising a supported collar and cuffs of a shirt into pressing engagement with the fixed platens and for lowering the supplemental buck away therefrom after pressing; and supplemental steam lines coupling the supply of steam to the supplemental buck and fixed platens when the collar and cuffs are being pressed therebetween.

2. Apparatus for pressing a shirt comprising:

a shirt buck having a front and a back and opposite lateral sides therebetween and adapted to hold at least the front and back of the shirt in an orientation for being pressed, the shirt buck also including an air and steam inlet and a vacuum outlet;

drive means to laterally move the shirt buck between a loading zone and a shirt finishing zone;

a pair of chests positioned adjacent to the shirt buck at the shirt finishing zone, the chests being movable between an inoperative position remote from the shirt buck and an operative position proximate to each other and the shirt buck and in pressing contact with a shirt on the shirt buck;

drive means to laterally move the chests between the inoperative and operative positions;

steam lines coupling the steam inlet to a supply of steam;

a supplemental buck having a central section for receiving thereon the collar of a shirt to be pressed and, on opposite sides thereof a pair of lateral sections for receiving thereon the cuffs of a shirt to be pressed with mounting means to support the central and lateral sections for concurrent movement;

a plurality of fixed platens including a central platen for receiving therebeneath the collar of a shirt to be pressed with the central section of the supplemental buck therebeneath and with a pair of laterally disposed platens for receiving therebeneath the cuffs of a shirt to be pressed with the lateral sections of the supplemental buck therebeneath;

drive means to shift the supplemental buck between the loading zone, the same as for the shirt buck, and a collar and cuffs pressing zone for moving a supported collar and cuffs of a shirt into pressing engagement with the fixed platens and for removing the supplemental buck away therefrom after pressing; and supplemental steam lines coupling the supply of steam to the collar and cuffs pressing zone.

3. A method for pressing a shirt comprising:

providing a shirt buck having a front and a back and opposite lateral sides therebetween and adapted to hold at least the front and back of the shirt in an orientation for being pressed, the shirt buck also including an air and steam inlet and a vacuum outlet;

providing a drive means to laterally move the shirt buck between a loading zone and a shirt finishing zone;

providing a pair of chests positioned adjacent to the shirt buck at the shirt finishing zone, the chests being movable between an inoperative position remote from the shirt buck and an operative position proximate to each other and the shirt buck and in pressing contact with a shirt on the shirt buck;

providing a drive means to laterally move the chests between the inoperative and operative positions;

providing steam lines coupling the steam inlet to a supply of steam;

providing a supplemental buck having a central section for receiving thereon the collar of a shirt to be pressed and, on opposite sides thereof a pair of lateral sections for receiving thereon the cuffs of a shirt to be pressed with mounting means to support the central and lateral sections for concurrent movement;

providing a plurality of fixed platens including a central platen for receiving therebeneath the collar of a shirt to be pressed with the central section of the supplemental buck therebeneath and with a pair of laterally disposed platens for receiving therebeneath the cuffs of a shirt to be pressed with the lateral sections of the supplemental buck therebeneath;

providing a drive means to shift the supplemental buck between the loading zone, the same as for the shirt buck, and a collar and cuffs pressing zone for moving a supported collar and cuffs of a shirt into pressing engagement with the fixed platens and for removing the supplemental buck away therefrom after pressing;

providing supplemental steam lines coupling the supply of steam to the collar and cuffs pressing zone; and activating the various drive means in a cycle of operation to press a shirt body and collar and cuffs.

* * * * *